US005470518A

United States Patent [19]

Dais et al.

[11] Patent Number: 5,470,518

[45] Date of Patent: Nov. 28, 1995

[54] PROCESS AND APPARATUS FOR CONTROLLING THE GAP WIDTH OF A RECLOSABLE CLOSURE PROFILE FOR A THERMOPLASTIC CONTAINER

[75] Inventors: Brian C. Dais; Jose Porchia, both of Midland, Mich.

[73] Assignee: DowBrands L.P., Indianapolis, Ind.

[21] Appl. No.: 193,333

[22] Filed: Feb. 8, 1994

Related U.S. Application Data

[62] Division of Ser. No. 926,985, Aug. 7, 1992, Pat. No. 5,363,540.

[51] Int. Cl.[6] ..... B29C 47/90

[52] U.S. Cl. ..... 264/145; 156/66; 156/244.14; 156/244.18; 156/244.24; 156/244.25; 264/177.17; 264/177.19; 425/315; 425/325; 425/142; 425/291

[58] Field of Search ..... 264/177.10, 177.16, 264/177.17, 177.19, 145–146; 425/325, 315, 310, 291, 142; 156/66, 244.14, 244.24, 244.25, 244.18

[56] References Cited

U.S. PATENT DOCUMENTS

| | | | |
|---|---|---|---|
| 2,039,887 | 5/1939 | Colletti | 383/63 |
| 2,791,807 | 5/1957 | Morin . | |
| 2,975,496 | 3/1961 | McGraw | 24/587 |
| 3,219,084 | 11/1965 | Ausnit et al. . | |
| 3,338,285 | 8/1967 | Jaster | 383/65 |
| 3,372,442 | 3/1968 | Ishimatsu | 24/587 |
| 3,416,199 | 12/1968 | Imamura | 24/587 |
| 3,500,727 | 3/1970 | Behr et al. | 264/146 |
| 3,517,702 | 6/1970 | Mueller et al. | 24/587 |
| 3,532,571 | 10/1970 | Ausnit | 156/244.14 |
| 3,595,949 | 7/1971 | Staller . | |
| 3,808,649 | 5/1974 | Ausnit et al. | 383/63 |
| 3,848,035 | 11/1974 | Behr | 264/569 |
| 3,852,386 | 12/1974 | Behr | 264/569 |
| 4,115,495 | 9/1978 | Hartitz | 264/567 |
| 4,249,982 | 2/1981 | Ausnit | 156/66 |
| 4,419,159 | 12/1983 | Herrington . | |
| 4,563,319 | 1/1986 | Ausnit et al. | 156/66 |
| 4,629,524 | 12/1986 | Ausnit | 156/66 |
| 4,666,536 | 5/1987 | Erden et al. . | |
| 4,676,851 | 6/1987 | Scheibner et al. | 156/66 |
| 4,906,310 | 3/1990 | Broderick et al. . | |
| 5,049,223 | 9/1991 | Dais et al. | 264/177.19 |
| 5,053,091 | 10/1991 | Giljam et al. | 156/66 |
| 5,070,584 | 12/1991 | Dais et al. | 24/587 |
| 5,106,566 | 4/1992 | McCree . | |

*Primary Examiner*—Jeffery R. Thurlow

[57] ABSTRACT

A process and apparatus for forming a reclosable closure profile, wherein the configuration of the closure profile is mechanically altered for controlling the width of the gap in a groove member by passing the closure profile, while still hot enough to be formed, through a profile gapping means, whereby the surfaces of the closure profile contact the gapping means, thereby maintaining the desired final gap width of the closure profile and/or whereby the gapping means includes a cutting means for notching the base of the groove member for controlling the closure force of the groove member.

23 Claims, 6 Drawing Sheets

PROCESS AND APPARATUS FOR CONTROLLING THE GAP WIDTH OF A RECLOSABLE CLOSURE PROFILE FOR A THERMOPLASTIC CONTAINER

CROSS-REFERENCE TO RELATED APPLICATION

This is a divisional of application Ser. No. 07/926,985, filed Aug. 7, 1992, now U.S. Pat. No. 5,363,540, issued Nov. 15, 1994.

FIELD OF THE INVENTION

This invention relates to plastic containers having interlocking reclosable closure profiles, and more particularly, to a process and apparatus for controlling the configuration and certain critical dimensions of the interlocking closure profiles, such that mated closure profiles tightly interlock together.

BACKGROUND OF THE INVENTION

Reclosable plastic containers made from a thermoplastic sheet having opposing rib and groove fastener elements (also called male and female interlocking closure profiles) are well known and described, for example, in U.S. Pat. Nos. 4,736,496; 4,741,789; 4,755,248; 4,764,977; 4,812,056; 5,009,828; 5,012,561; 5,022,530 and 5,070,548. One example of such a reclosable plastic container or bag is the Ziploc® brand food storage bag.

Typically, the male and female-type interlocking closure profiles are either manufactured separately-as strips and thereafter attached to a web of polymeric sheet as described in U.S. Pat. No. 3,462,332 or the closure profiles and sheet are extruded as an integral unit from a single die such as described in U.S. Pat. No. 3,340,116.

The industry is aware that width of the gap in the female or groove member of the closure profile is crucial to the proper functioning and accurate mating of the groove and rib or head members. Where the gap is too wide, for example, the closure profiles separate too easily providing a weak closure for plastic containers and resulting in leakage through the closure of the plastic container. Where the gap is too narrow, the closure profiles are difficult to mate together, both during manufacture of the plastic containers and later by the end user of the final product. There is, therefore, a need in the industry to properly, accurately and consistently control the gap width of the female profile.

Various methods have heretofore been used to control gap width of a female profile which, generally, include streams of gaseous or liquid coolant directed onto the surfaces of the closure profiles. For example, U.S. Pat. No. 5,106,566 issued to McCree discloses a process and apparatus for controlling the gap width of a female closure profile and fixing the configuration of the profile while simultaneously cooling the profile utilizing a flow of cooling fluid onto the closure profile.

While the method and apparatus disclosed in U.S. Pat. No. 5,106,566 is satisfactory, it is desired to provide an alternative process and apparatus for controlling gap width of a closure profile which could be used without the need for a liquid coolant for the specific purpose of maintaining the gap width because using a flow of liquid, alone, can still provide inconsistent gap widths depending on the control of such things as container stock production rates and conditions, the liquid coolant pressure, temperature and direction of application and force of a liquid coolant impinging upon the surfaces of the closure profiles.

It is, therefore, desired to provide a process and apparatus for accurately controlling the critical dimensions of a closure profile, during the manufacture of plastic container stock material at varying production rates, by mechanically maintaining the gap width of the closure profile.

It is also desired to provide a process and apparatus for mechanically altering a closure profile by a slight permanent deformation, resulting in a desired closure profile configuration having a desired predetermined fixed closure force.

SUMMARY OF THE INVENTION

One aspect of the present invention is directed to precisely controlling the width of the gap in a groove member by passing the closure profile, while still hot enough to be formed, through a profile gapping means, whereby the surfaces of the closure profile contact the gapping means, thereby establishing the desired final gap width of the closure profile.

Another aspect of the present invention is directed to altering the configuration of a profile using the gapping means such that a desired closure profile configuration is obtained that will result in a desired predetermined closure force.

Either embodiment of the present invention is advantageously practiced at any point following the extrusion of the closure profile in a manufacturing process for producing reclosable plastic containers. For example, a closure profile configuration may be altered for closure profile strips prior to attachment to a polymeric sheet; or a closure profile configuration may be altered for closure profiles which are already an integral part of a plastic container stock material.

One embodiment of the present invention includes an apparatus for maintaining the gap between the arm portions of a female profile member at a certain width for a reclosable plastic container comprising a rigid separator element means adapted to be placed between the two arm portions of the female profile to maintain the arm portions separated and apart whereby the gap of the female profile is maintained at a consistent width while forming the female profile.

Precise control and accurate dimensions for the gap width of a female profile may be achieved through the use of a preferred embodiment of the device for maintaining the gap at a certain width between the arm portions of a female profile member comprising:

- a U-shape holding bracket having two leg member portions general to a back portion when viewed in cross-section;
- a stationary shaft positioned substantially perpendicular between the two leg members; and
- a center circular shim member mounted at its center axis on the shaft, said shim member adapted for contacting the inner walls of the arm portions of a female profile and for providing a predetermined gap in the female profile.

The aforementioned apparatus and method of use may be employed in the manufacture of plastic container stock material, from which resealable plastic bags or resealable rigid containers may be manufactured.

DETAILED DESCRIPTION OF THE PREFERRED EMBODIMENTS

A typical plastic container having interlocking closure profiles may be produced from a thermoplastic polymeric sheet having interlocking closure profiles on its surface. The sheet, having integral closure profiles thereon, may be used to manufacture bags or other containers which are closable by interlocking one closure profile with another mating profile. Such profiles are commonly designed to be reclosable once opened.

Figure 1:
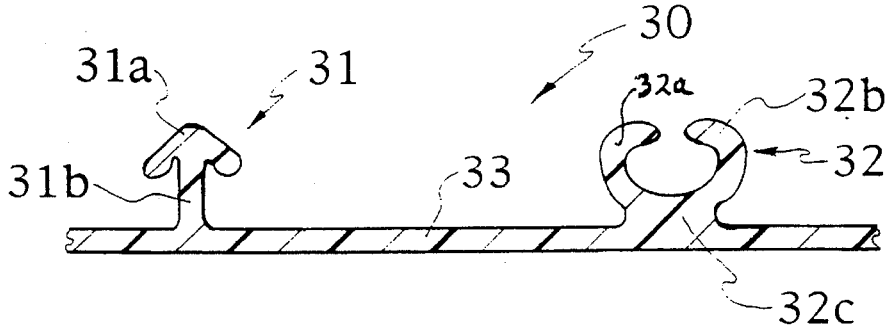
FIG. 1 is a cross-sectional view taken through a thermoplastic polymeric film, illustrating head and groove interlocking closure fastening devices thereon.
Figure 2:
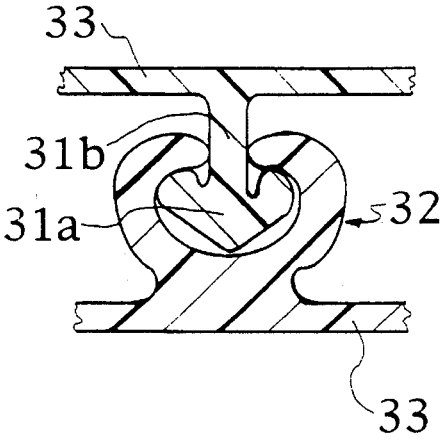
FIG. 2 is an enlarged cross-sectional view showing interlocked closure profiles.
Figure 3:
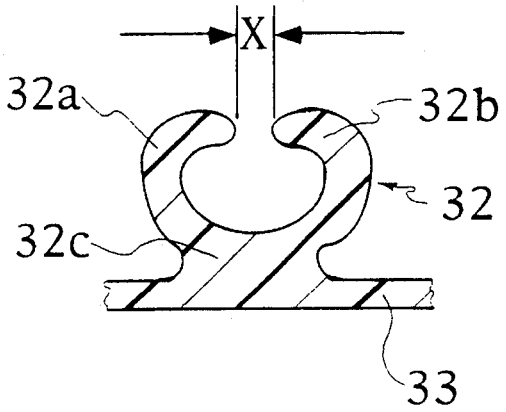
FIG. 3 is an enlarged cross-sectional view showing a female profile.

Stock material 30 useful for producing a plastic container is shown in FIGS. 1–3 which includes a typical set of closure profiles 31 and 32, which in combination with a thermoplastic polymeric sheet 33, comprise the integral plastic container stock material 30. Thermoplastic polymeric materials from which the sheet and closure profiles are generally made of polyethylene, polypropylene, nylon and other thermoplastic material which may be formed by extrusion.

Generally, one of the closure profiles 31, usually designated as the head member or male profile 31, is arrow-head shaped having an enlarged head portion 31*a* and a stem portion 31*b* which attaches the head portion 31*a* to the polymeric sheet 33. The mating closure profile 32, commonly designated as the groove member or female profile 32, basically comprises a "U-shaped" member having spaced-apart upstanding arm portions 32*a* and 32*b* attached to the polymeric sheet 33, generally by a somewhat thicker base portion 32*c*. The parts of the female profile 32 together define a gap, designated by an "X" (shown in FIG. 3), into which the aforementioned head portion 31*a* is received as shown in FIG. 2. The distal areas of the arm portions 32*a* and 32*b* normally hook inwardly to firmly lock the head portion 31*a* therebetween.

It is to be understood that the thermoplastic polymeric sheet 33 may contain more than one of each kind of closure profile 31 and 32, depending on the processes used for the subsequent manufacturing of plastic containers from the stock material 30. As initially extruded, whether as a composite or integral extrusion, the groove member closure profile 32 of the plastic container stock material 30 has a preliminary configuration, having dimensions differing from the ultimately desired dimensions of the finished closure profile. Generally, as initially extruded the gap "X" of the groove member 32 is inconsistent and non-uniform. Upon passing the profile 32 through the apparatus of the present invention, while the profile is still fusible or formable, the gap "X" of the profile can be maintained at a predetermined width until the gap is fixed upon subsequent cooling of the profile 32.

Figure 4:
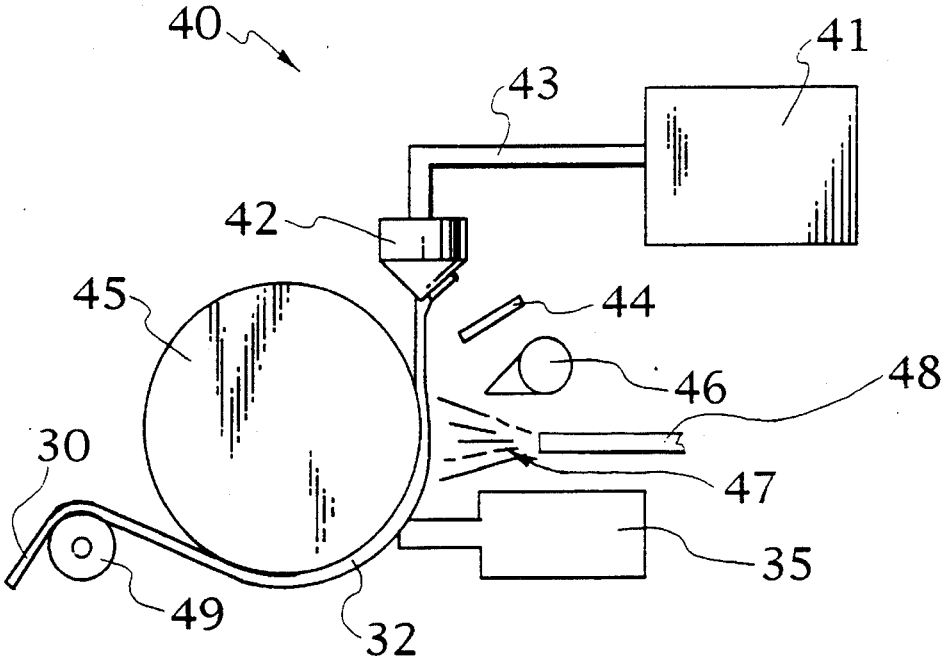
FIG. 4 is a schematic elevational view of an apparatus for forming a web and closure profile including the apparatus of the present invention.

With reference to FIG. 4, there is shown one embodiment of the overall manufacturing process and apparatus 40 for producing the plastic stock material 30 and the relative position of the apparatus of the present invention 35 (schematically shown) with respect to the groove profile 32. In FIG. 4, there is shown a supply of molten thermoplastic material from a conventional screw extruder 41 feeding a slot extrusion die 42 via an extruder pipeline 43. The die 42 is used for forming the profiles 31 and 32 and film web or sheet 33. Various dies 42 may be used and are described, for example, in U.S. Pat. Nos. 4,263,079 and 4,515,647. A pinning airjet 44 pins the stock material 30 at its edges to a chill cast roll 45. An air knife 46 directs air across the width of the film web for improved film cooling and flatness, while water jets 47 from a nozzle 48 helps cool the stock material 30.

The apparatus of the present invention 35 is preferably positioned subsequent to the water jets 47 and prior to a series of idle, nip or guide rollers 49 as shown in FIG. 4. It is to be understood, however, that the apparatus of the present invention 35 can be positioned anywhere in-line, preferably while the groove profile 32 is still formable. At any one particular location along the process, the apparatus of the present invention 35 includes means for moving the apparatus 35 into contact with the profile 32.

Processes for preparing the stock material 30 are described, for example, in U.S. Pat. Nos. 3,462,332 and 3,340,116. One preferred embodiment for preparing the stock material 30 is described in U.S. Pat. No. 5,070,584, incorporated herein by reference, which discloses a zipper that creates a clicking noise when the zipper is being opened or closed and further wherein the zipper imparts a vibration or bumpy feel which is tactile and readily perceptible to the touch when the zipper is closed.

Generally, the groove member closure profile 32, while it retains sufficient heat from the extrusion process to be formed, is passed through an apparatus of the present invention 35 to fix the final desired width "X" of the gap of the closure profile 32.

Figure 5:
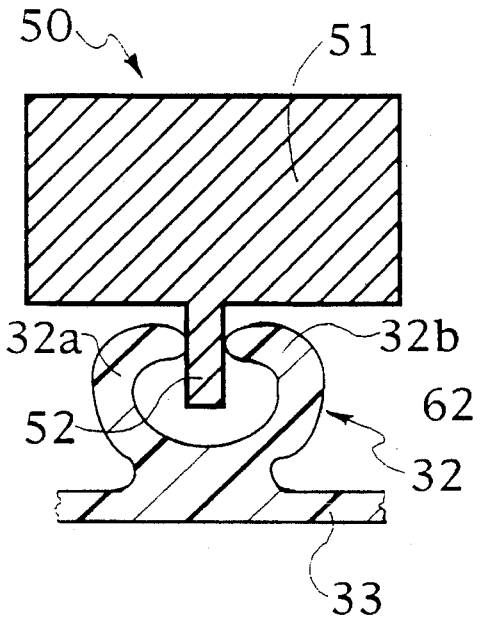
FIGS. 5–8 are cross-sectional views of various embodiments of the apparatus of the present invention.

In its simplest and broadest scope, one embodiment of the apparatus or device 50 of the present invention, indicated generally by numeral 50 and shown in FIG. 5, includes a base portion member 51 having a ridge or rib portion 52 of a predetermined thickness and adapted to be in contact with a female profile 32 between the arm portions 32*a* and 32*b* of the female profile 32 for maintaining the gap therebetween. The embodiment shown in FIG. 5 is advantageously used when the female profile 32 is first extruded with a slightly narrower gap between the profile's arm portions 32*a* and 32*b* prior to contacting the apparatus 50; and then when the arm portions 32*a* and 32*b* of the profile 32 receive the rib portion 52, the gap of the profile 32 is controlled to a certain predetermined width. The apparatus 50 is attached to conventional positioning means (not shown) for moving the rib portion 52 into contact with the female profile 32 and adjusting the depth of the distal end of the rib portion 52.

Figure 6:
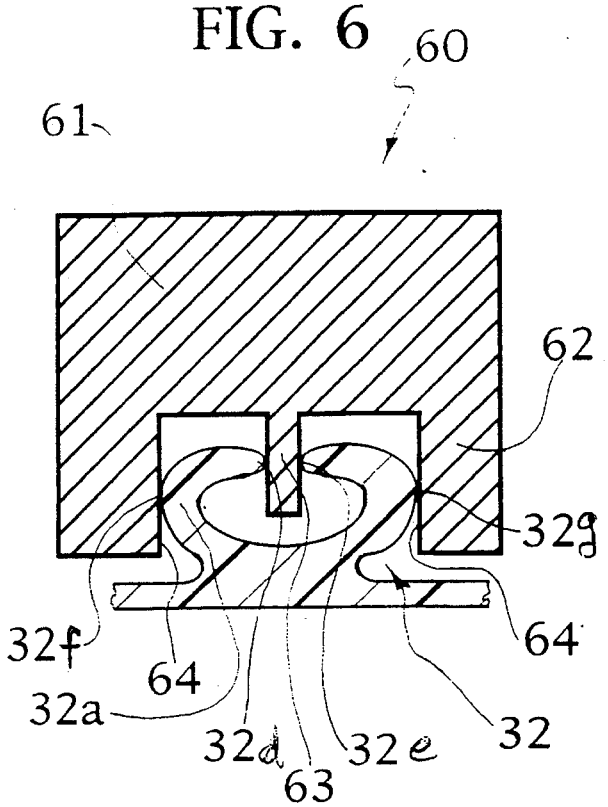

Another embodiment of the apparatus of the present invention shown in FIG. 6 includes an "M-shaped" channel member 60 when viewed in cross-section. The apparatus 60 comprises a base portion member 61 with two leg portions 62 and a rib portion 63 generally spaced apart and centered between the two leg portions 62. The rib portion 63 is adapted for receiving the gap of a female profile 32. Channel member 60 is designed to accommodate passage therethrough of the groove member closure profile 32, and simultaneously therewith to provide contact between the outer portions 32*f* and 32*g* of the arm portions 32*a* and 32*b* of the groove member closure profile 32 and the inner sidewalls 64 of the leg portions 62 of the channel member 60, while the inner portions 32*d* and 32*e* of the arm portions 32*a* and 32*b*, respectively, of the groove member closure profile 32 are in contact with the rib portion 63, as depicted in FIG. 6. The sidewalls 64 alter and confine, by mechanically contacting, the arm portions 32*a* and 32*b* of the groove member closure profile 32 while the rib portion 63 alters and maintains the gap width of the closure profile 32. Each apparatus 60 is designed with rib and leg portion dimensions for a particular sized profile. While the apparatus 60 is shown fixed, the apparatus 60 may be designed with adjustable means (not shown) whereby the dimensions of the space between the inner sidewalls 64 of leg portions 62 and the rib portion 63 can be varied without replacing apparatus 60 each time a different profile configuration is used.

Either embodiments shown in FIGS. 5 or 6 can contain one or more apertures (not shown) provided from the base portion and through the rib portion, similar to those shown in U.S. Pat. No. 5,106,566, incorporated herein by reference, through which a cooling fluid, such as air or water, may pass for spraying the profile 32 as the profile 32 passes through the apparatus 50 or 60. In this instance, the cooling fluid is used for further cooling the profile while the rib portion controls the gap of the profile.

Figure 7:
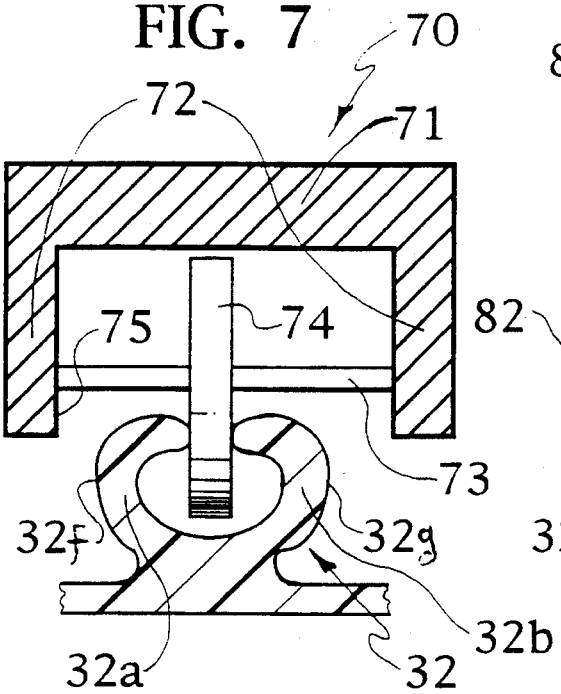

FIG. 7 shows another embodiment of the present invention comprising a "U-shaped" channel member 70 (when viewed in cross-section) having a base portion 71 and leg portions 72 including a shaft member 73 mounted between the leg portions 72 and a shim member 74 mounted to the shaft 73. The shim member 74 generally is a circular disk or washer-type member of a predetermined thickness which can be rotatably mounted on the shaft 73 or permanently fixed to shaft 73. Alternatively, the shaft 73 may be rotatably attached to the leg portions 72 or in a fixed or stationary position to the leg portions 72. Preferably the shim 74 is rotatably attached and slideably mounted on shaft 73 to move the shim 74 along the axis of the shaft 73. When in contact with the female profile 32, in one instance, only the shim 74 can be in contact with the profile 32, shown in FIG. 7, or if desired, in one embodiment not shown, the leg portions 72 can extend a predetermined length beyond the length of the shim 74 such that the inner sidewalls 75 of the leg portions 72 contact the outer portions 32*f* and 32*g* of the arms portions 32*a* and 32*b* of the profile 32 similar to that shown in FIG. 6. Preferably, the shim 74, alone, is in contact with the profile 32 as shown in FIG. 7. Alternatively, if desired, the entire apparatus 70 can be slideably mounted on a shaft (not shown) through base portion 71 for adjusting the position of the shim member 74 via the whole apparatus 70.

Figure 8:
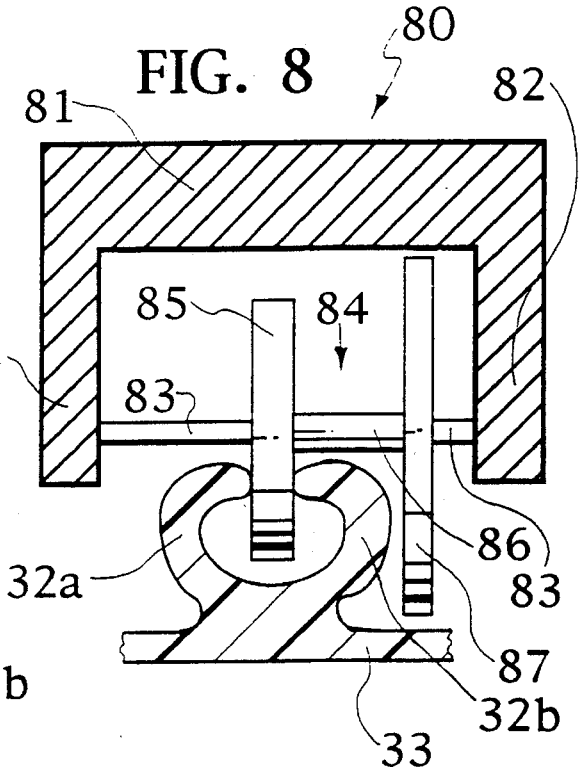

Regarding FIG. 8, there is shown still another embodiment of the apparatus of the present invention 80 including a "U-shaped" channel member comprising a base portion 81 and two leg portions 82 and a shaft member 83 attached to and between the leg portions 82 with a "spool-type" shim member, generally indicated by numeral 84, mounted on the shaft 83. The shim member 84, in this instance, comprises circular washer-type shim portion 85 connected by a tubular portion 86 to a circular washer-type depth indicating means portion 87 together forming the "spool-type" member 84. In operation, the depth indicator 87 contacts the sheet 33 first as the apparatus 80 is moved vertically in a downward direction between the arm portions of the profile 32. Thus, by viewing the slightest of scratching or abrasion on the surface of the sheet 33 as the profile is passed through the apparatus 80, one can determine the distance to retract the device 80 a predetermined distance to avoid damage to the base of the profile 32. While, in this instance, the shim 84 is integral with a depth indicator 87, as shown in FIG. 8, the shim portion 85 and depth indicator 87 can be separate elements (not shown) without being connected by a tubular portion 86, preferably, rotatably mounted independently on shaft member 83.

Figure 9:
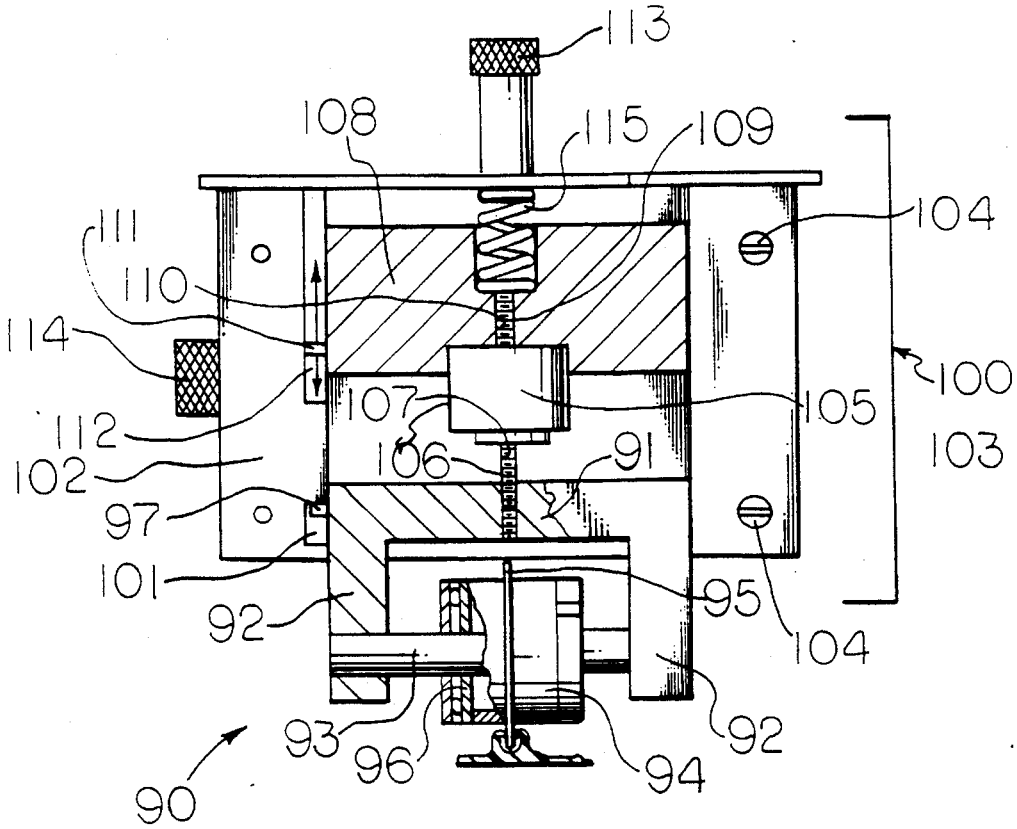
FIG. 9 is a top elevational view, partly in cross-section and partly broken away, showing another embodiment of the apparatus of the present invention.
Figure 10:
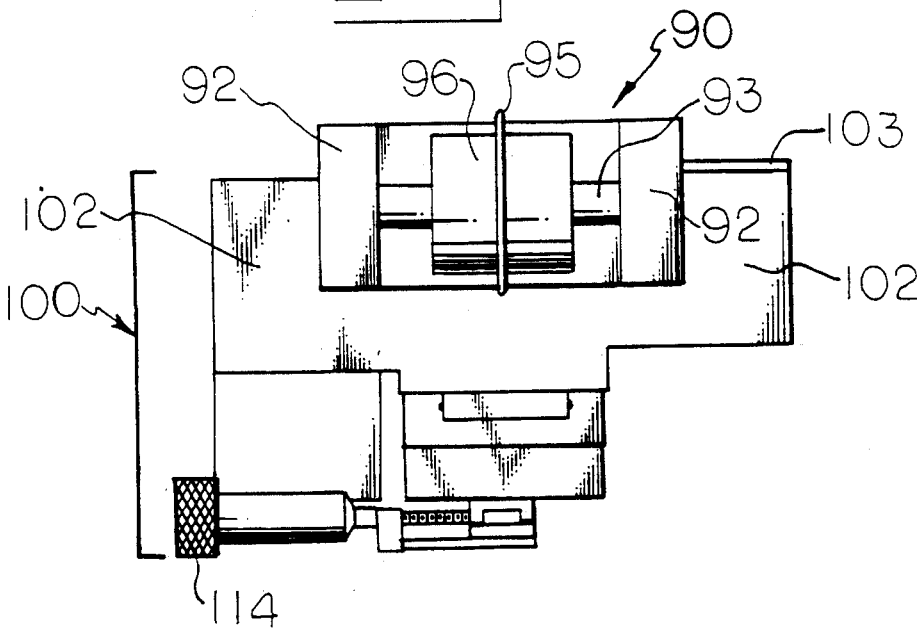
FIG. 10 is a front elevational view of the apparatus of FIG. 9.
Figure 11:
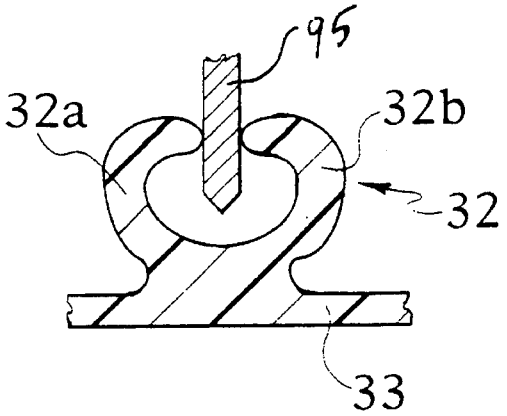
FIG. 11 is an enlarged cross-sectional view of a portion of the apparatus of FIG. 9 between the gap of a female profile.

In a preferred embodiment, shown in FIGS. 9–11, the apparatus of the present invention, generally indicated by numeral 90, includes a "U-shaped" bracket member comprising a base portion 91 and leg portions a shaft member 93 attached to the leg portions 92; and a rotatably mounted cylindrical shim base support member 94 with an integral shim portion 95 circumferentially attached to the center of the cylindrical shim base support member 94. The support member 94 preferably rotates on the shaft 93 on bearing 96.

The apparatus 90 is attached by any means to a positioning means generally indicated by numeral 100. The attachment of apparatus 90 to the positioning means 100, in this instance, is made by pin members 97 (one shown) attached to the base portion 91 and slideably mounted in grooves 101 of the body 102 of the positioning means 100. The pins 97 are preferably secured to the body 102 by plate members 103 (one shown) and screws 104. A load cell 105 is also removably attached to the base portion 91 of the bracket member, in this instance, using a threaded rod 106 and bore 107. The load cell 105 is advantageously used to determine the amount of force exerted on a female profile as the shim is being inserted between the arm portions of the female profile. The indicated force can be used as a depth indicator (to prevent damage to the profile) and to indicate whether or not the shim is actually aligned in between the arm portions of the female profile.

The load cell 105 is also attached to a housing 108 for the load cell 105 using a threaded rod 109 and bore 110. Pins 111 (one shown) attached to the housing 108 are slideably mounted in grooves 112 (one shown) in the body 102 and the housing 108 is secured to the body 102 by plate members 103 and screws 104. The grooves 112 are used for guiding the housing for the load cell and the grooves 101 are used for guiding apparatus 90 as pressure is exerted against the profile by the shim portion 95. The plate members 103 secure together the apparatus 90 and the housing 108 for the load cell 105.

Attached to the body 102 of the positioning means 100 are first and second micrometers 113 and 114 for adjusting and indicating the depth and lateral direction, respectively, of the shim 95. A load cell overload protection spring 115 can be installed in the housing 108 for protecting the load cell 105 from excessive force applied to it. The entire system, apparatus 90 and positioning means 100 with the load cell assembly, is installed for use, for example, on an existing support frame member (not shown) adjacent the profile 32. For example, FIG. 11 shows the position of the shim portion 95 between the arm portions 32*a* and 32*b* of the female profile 32.

Figure 12:
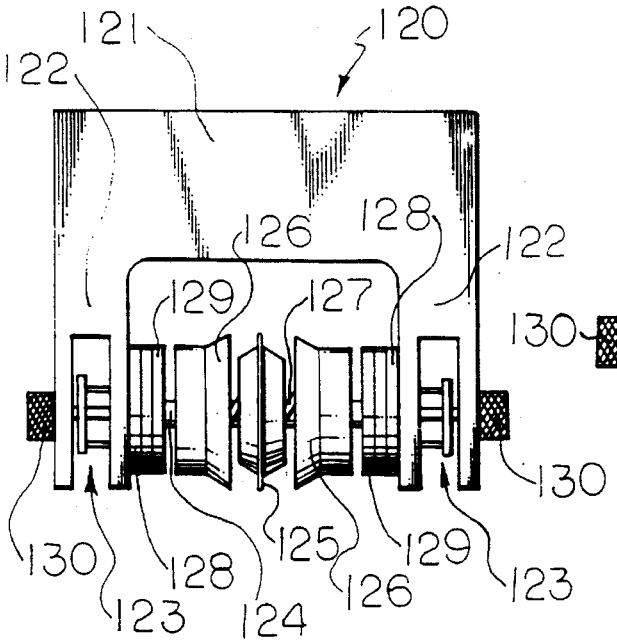
FIG. 12 is a top elevational view of still another embodiment of the apparatus of the present invention.
Figure 13:
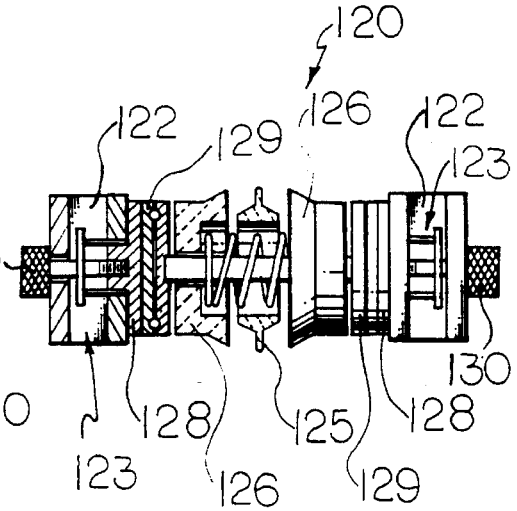
FIG. 13 is a front view, partly cross-sectional and partly elevational, of the apparatus shown in FIG. 12.
Figure 14:
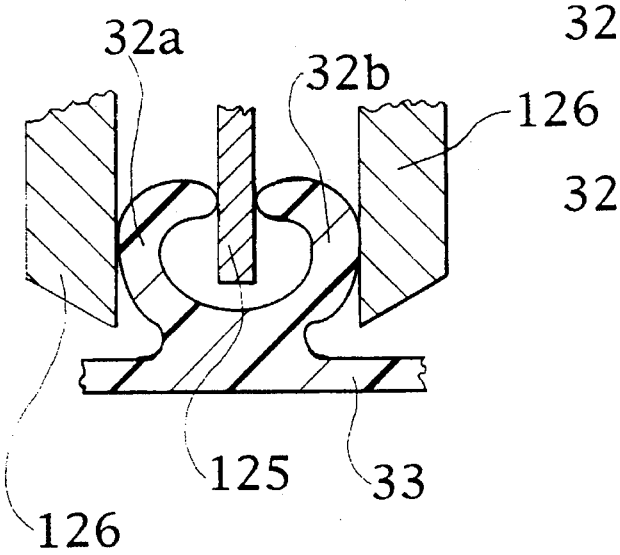
FIG. 14 is an enlarged cross-sectional view of a portion of the apparatus of FIG. 12 between the gap of a female profile.

With reference to FIGS. 12–14, there is shown yet another embodiment of the apparatus of the present invention, generally indicated by reference numeral 120, including a "U-shaped" bracket member comprising a base portion 121 and leg portion members 122, each leg portion 122 with slots 123; a shaft 124 is mounted between the leg portion 122; a shim member 125 is rotatably mounted on said shaft 124; and outer ring members 126 are slideably mounted on shaft 124 with springs 127 biased against the outer ring members 126. Other biasing means can be used instead of springs 127 such as an air supply piston. Retaining rings 128 are also mounted on the shaft 124; and, optionally, load cells 129 can be mounted on shaft 124. The load cells 129, in this embodiment, can be used to measure the force exerted on the arm portion of a female profile and also determine the width of confinement of the profile. An adjusting means 130 is also provided on shaft 124, in this instance screw members 130, for moving or controlling the movement of the outer rings 126 inwardly and outwardly.

The shim 125 and the other components on the shaft 124 are preferably rotatable to provide less friction and uniform wear of the components and, more importantly, to prevent roughening of the surface of the profile and maintain the smoothness of the operation and profile surface. Generally the materials of construction of the apparatus 120 are not critical, but the shim and ring members are preferably made of tungsten carbide or polytetrafluoroethylene. FIG. 14 shows the position of the arm portions 32*a* and 32*b* of the female profile 32 between the outer rings 126 and shim member 125.

In carrying out the process of the present invention, the shim portion of the apparatus of the present invention is brought into contact with the groove member closure profile 32, while the profile still contains enough residual heat from the extrusion process to be formed. The rib or shim portion is positioned between the arm portions 32*a* and 32*b* of the closure profile 32 while the closure profile is cooled thereby fixing the width of the gap between the arm portions of the profile. Generally, the thickness of the shim portion is from about 5 mils to about 25 mils.

Figure 15A:
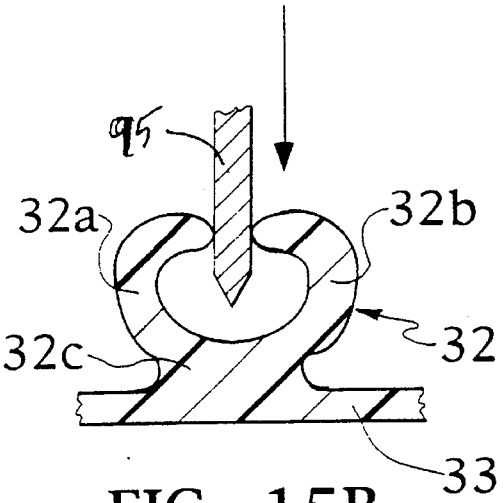
FIGS. 15A, 15B and 15C are a series schematic views showing an apparatus of the present invention making a notch in the base of a female profile as shown in FIG. 15C.
Figure 15B:
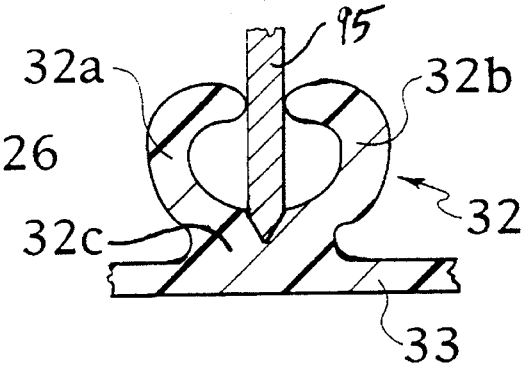
Figure 15C:
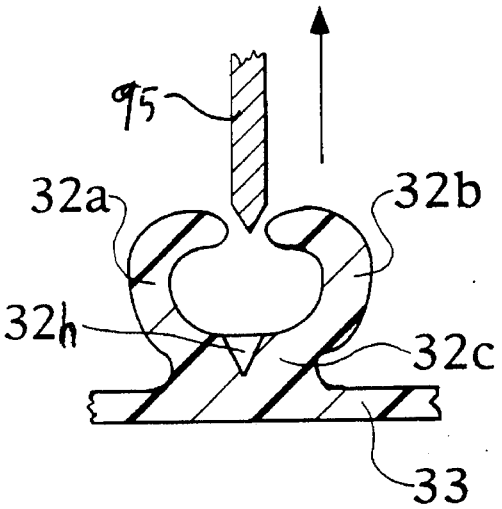
Figure 16:
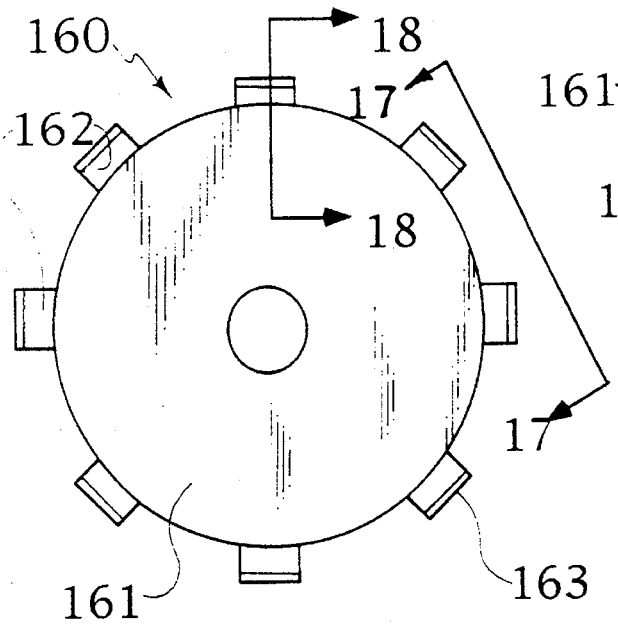
FIG. 16 is a side view showing one embodiment of a shim member of the present invention.
Figure 17:
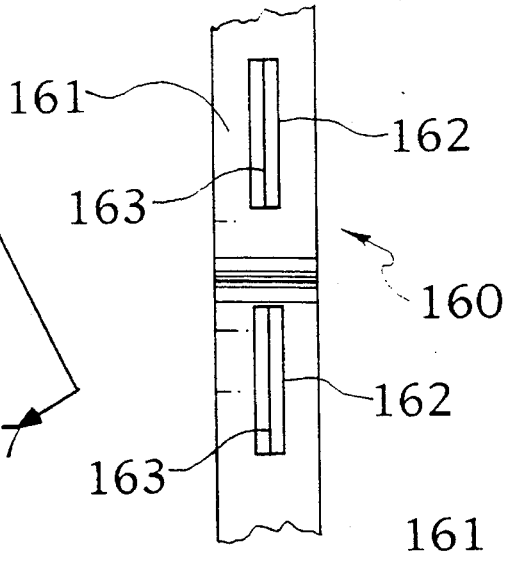
FIG. 17 is a front view taken along line 17—17 of FIG. 16.
Figure 18:
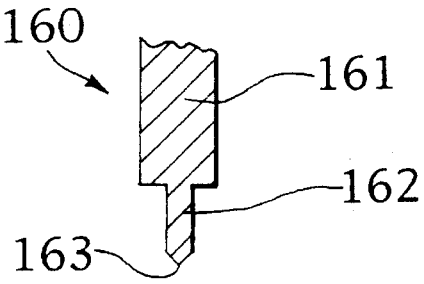
FIG. 18 is a cross-sectional view taken along line 18—18 of FIG. 16.

Referring now to FIGS. 15A, 15B and 15C, it is also contemplated in this invention to use the aforementioned apparatuses for altering or modifying the closure force of the profile 32 without the need for producing separate profiles, using separate equipment or changing out dies for producing separate profiles. By providing a knife-edge on the shim portion of the present invention, the shim can be used to notch or cut (32*h*) the base 32*c* of a profile to a desired depth and width as shown in the series of FIGS. 15A to 15C. This method provides an inexpensive or less complex way of modifying or lowering the closing force of a profile being extruded from an existing die. Thus, a profile plate with special dimension is not required for producing a profile with varying closure forces. In the past, in order to lower the closing force of a female profile, the arm portions of the profile were extruded thinner which resulted in flimsy arms which lost their integrity. Alternatively, the base of the female profile was made thinner, but again, this alternative method resulted in a profile without integrity. Another undesirable option was to make the gap wider, but this resulted in closure leakage. The present process of notching an existing female profile in a controlled procedure eliminates the problem of the prior art methods.

The notching procedure shown in FIGS. 15A–15C can be carried out without necessarily providing or maintaining a desired gap, for example, by using a thinner shim than the gap of the profile. However, gapping and cutting is preferably simultaneously carried out. For simultaneous gapping and cutting, the shim can be of a uniform thickness except for a sharp edge as shown in FIGS. 15A–15C, or, the shim can have a varying thickness as shown in FIGS. 16–19. Also, the cutting process can be continuous or intermittently providing a continuous notch or an intermittent notch along the base of a female profile. An intermittent notch 32*h* is preferred, because a continuous cut, no matter how shallow, will provide the weakest profiler while an intermittent cut provides better control of the strength of the profile both from a structural and closure force standpoint.

For intermittent cutting, the simplest procedure is to move a uniform thickness cutting shim member up and down vertically against the base of the profile at desired intervals. In another embodiment, a shim member 160 of varying thickness as shown in FIGS. 16–19, can be used and positioned against a profile at a predetermined depth without the need for raising and lowering the shim member 160 into the base of the profile once the shim is in position.

Figure 19:
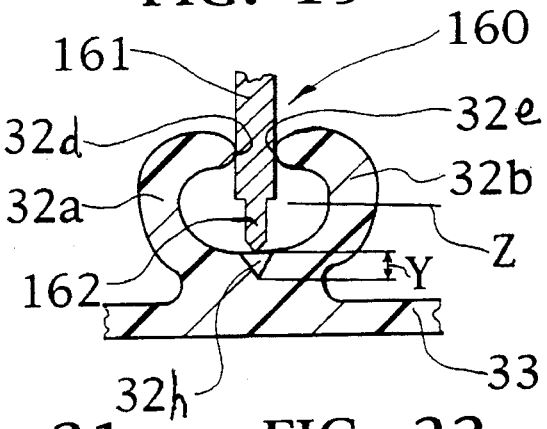
FIG. 19 is an enlarged cross-sectional view of a portion of the shim member of FIG. 16 between the gap of a female profile.

As shown in FIGS. 16–19, the shim 160 comprises a thick base portion 161 with a plurality of thinner spaced apart rib portions 162. The rib portion preferably contains a knife-edge 163 for ease of cutting. When adjusting the depth of the notch 32*h* in the profile indicated by the distance "Y" the travel of the base portion 161 of the shim can not be retracted beyond the point "Z", or in other words, for simultaneous gapping and intermittent notching, the base portion 161 of the shim 160 must always contact the distal position inner walls 32*d* and 32*e* of arm portions 32*a* and 32*b*, respectively, of the profile 32 as shown in FIG. 19. Otherwise, an undesirable or intermittent gap will result.

Figure 20:
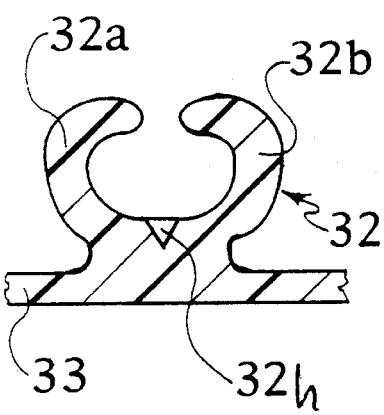
FIGS. 20–22 are cross-sectional views showing several embodiments of notched female profiles of the present invention.
Figure 21:
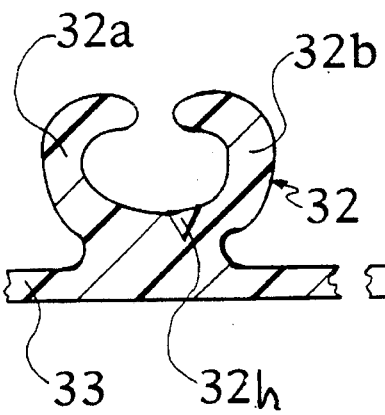
Figure 22:
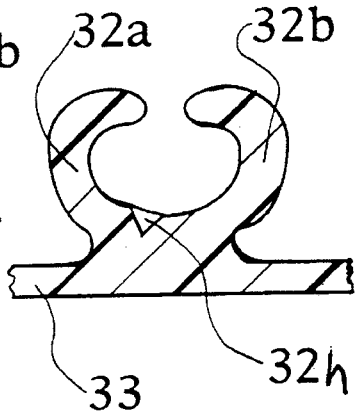

As shown in FIGS. 20–22, with the apparatus of the present invention, the notch 32*h* may be placed in various locations on the base 32*c* of the profile 32, for example, the notch 32*h* can be located at the center of the base 32*c* of the profile 32 or off-center in the base of either the right arm portion 32*b* (FIG. 21) or left arm portion 32*a* (FIG. 22) of the profile 32. Depending on where the notch 32*g* is placed in the profile, will determine the function of the profile, with respect to use with a plastic container closure. When the notch is positioned off-center the notch will weaken one or the other arm portions of the profile, for example, if the inner arm portion facing the inside of the plastic container is notched, then one can control the burst strength of the container. If the outer arm portion facing the external atmosphere of the container, is notched, then one can control opening force of the container. If the notch is in the center of the profile, this can be used to control closure force of the closure for the container.

Generally, the operation of initially forming a closure profile, and thereafter passing it through the apparatus of the present invention, is a continuous process.

In a preferred embodiment, the notching process is used in conjunction with the zipper profiles prepared by the process disclosed in U.S. Pat. No. 5,070,584, incorporated herein by reference, in order to obtain an optimum closure force while simultaneously obtaining an optimum audible clicking sound and/or vibratory or bumpy feel perceptible to the touch upon interlockment of the zipper profiles. By using the notching process to deform the female profile according to the present invention and deforming the male profile according to U.S. Pat. No. 5,070,584, a zipper profile with an optimum and controlled closure force can be obtained.

While certain representative embodiments and details have been shown for purposes of illustrating the present invention, it will be apparent to those ordinarily skilled in the art that various changes in applications can be made therein, and that the invention may be practiced otherwise than as specifically illustrated and described without departing from its spirit and scope.

What is claimed is:

1. An apparatus for maintaining the gap between arm portions of a female profile member at a certain width for a reclosable plastic container and capable of cutting a base portion of the female profile member comprising extrusion means for forming the female profile member, a rigid separator gapping means located downstream from said extrusion means adapted to be placed between the arm portions of the female profile while cooling for maintaining the arm portions separated and apart, said gapping means including a leading edge capable of cutting the base portion of the female profile member anywhere between said arm portions whereby the gap of the female profile is maintained at a consistent width upon cooling.

2. The apparatus of claim 1 including multiple apertures through which a cooling fluid may pass to contact and cool the closure profile while confined.

3. The apparatus of claim 1 wherein the rigid separator gapping means comprises a support base member portion integral with a rib portion wherein the rib portion is adapted to be placed between the arm portions of the female profile.

4. The apparatus of claim 1 wherein the rigid separator gapping means comprises an M-shaped channel member adapted to receive the female profile wherein the rib portion being the middle leg of the M-shaped member is positioned between the arm portions of the female profile.

5. The apparatus of claim 1 wherein the rigid separator gapping means comprises:

a U-shape holding bracket having two leg member portions general to a back portion when viewed in cross-section;

a stationary shaft positioned substantially perpendicular between the two leg members; and a center circular shim member mounted at its center axis on the shaft, said shim member adapted for contacting the inner walls of the arm portions of a female profile providing a predetermined gap for the female profile.

6. The apparatus of claim 5 including a means for confining the arm portions of the profile inwardly towards the separator element.

7. The apparatus of claim 6 including a first and second outer ring disc members mounted on their center axis on the shaft, said first ring member positioned on one side of the shim and said second ring member positioned on the other side of the shim, said ring members adapted to be in contact with the outer portion of the arm portions of the female profile.

8. The apparatus of claim 7 including a means for adjusting the position of the outer rings to slideably transfer the outer rings inwardly in or outwardly along the axis of the shaft.

9. The apparatus of claim 7 including a biasing means against the shim and outer rings to push the outer rings outwardly and to push the rings inwardly.

10. The apparatus of claim 7 wherein the biasing means is a spring member.

11. The apparatus of claim 7 wherein the biasing means is an air supply piston.

12. The apparatus of claim 1 wherein the thickness of the shim is from about 5 to about 25 mils.

13. The apparatus of claim 1 wherein the shim and rings are made of a tungsten carbide or polytetrafluoroethylene.

14. The apparatus of claim 1 wherein the shim is fixed on the shaft.

15. The apparatus of claim 1 wherein the shim contains a bearing and is movably mounted on said shaft for lateral movement along the axis of said shaft.

16. The apparatus of claim 1 including a micrometer for adjusting the shim portion of the apparatus to position vertically or laterally between the arm portions of the profile.

17. The apparatus of claim 1 including a depth indicator.

18. The apparatus of claim 1 including a load cell for monitoring the amount of force the female arm portions exerted on the outer rings.

19. The apparatus of claim 1 including a load cell for measuring the amount of force exerted against the arm portions of the female profile.

20. The apparatus of claim 1 including a means for adjusting the shim vertically between a gap of a female profile.

21. A process for preparing closure elements for plastic webs comprising:

extruding closure elements including a male profile and a female profile having a base portion and arm portions with a gap therebetween;

attaching said profiles in a formable condition to a plastic web;

gapping said female profile in said formable condition; and cutting the base portion of the female profile.

22. The process of claim 21 including maintaining the gap between about 5 to about 25 mils.

23. The process of claim 21 including adjusting the apparatus to adjust the gap.

* * * * *